US005127239A

United States Patent [19]

Manz et al.

[11] Patent Number: 5,127,239

[45] Date of Patent: Jul. 7, 1992

[54] REFRIGERANT HANDLING SYSTEM WITH FACILITY FOR CLEARING SYSTEM COMPONENTS OF REFRIGERANT

[75] Inventors: Kenneth W. Manz, Paulding; Mark E. Ramsey, Bryan, both of Ohio

[73] Assignee: SPX Corporation, Muskegon, Mich.

[21] Appl. No.: 681,365

[22] Filed: Apr. 8, 1991

[51] Int. Cl.[5] ..... F25B 45/00

[52] U.S. Cl. ..... 62/292; 62/85; 62/475

[58] Field of Search ..... 62/77, 85, 149, 292, 62/475, 474; 210/411, 278; 55/302

[56] References Cited

U.S. PATENT DOCUMENTS 4,805,416 2/1989 Manz et al. ..... 62/292

4,903,499 2/1990 Merritt ..... 62/149

*Primary Examiner*—Albert J. Makay

*Assistant Examiner*—J. Sollecito

*Attorney, Agent, or Firm*—Barnes, Kisselle, Raisch, Choate, Whittemore & Hulbert

[57] ABSTRACT

A refrigerant handling system that includes a compressor and a plurality of refrigerant system components connected in series between a refrigerant source, such as a system under service, and a refrigerant storage container. To clear a selected system component of refrigerant, such as a refrigerant filter or a refrigerant condenser, a valve is connected between the selected component and the compressor. The valve has multiple ports and valve positions, in one of which refrigerant is fed through the selected component to the storage container in normal operation, and in another of which the selected component is isolated from the storage container and connected to the pump inlet for drawing refrigerant from the component and feeding such refrigerant directly to the container. A check valve cooperates with the multi-port valve to isolate the selected component from the storage container during the clearing mode of operation.

5 Claims, 4 Drawing Sheets

REFRIGERANT HANDLING SYSTEM WITH FACILITY FOR CLEARING SYSTEM COMPONENTS OF REFRIGERANT

The present invention is directed to refrigerant handling systems of the type that include a refrigerant pump such as a compressor connected in series with a plurality of system components for feeding refrigerant to a storage container, and more particularly to an improvement in such a system for selectively clearing refrigerant from a system component such as a filter preparatory to performing maintenance on the filter or preparatory to use of the system with a differing type of refrigerant.

BACKGROUND OF THE INVENTION

U.S. Pat. No. 4,768,347 assigned to the assignee hereof discloses a refrigerant recovery system that includes a compressor having an inlet coupled through an evaporator and through a solenoid valve to refrigeration equipment from which refrigerant is to be withdrawn, and an outlet coupled through a condenser to a refrigerant storage container or tank. The refrigerant storage container is carried by a scale having a limit switch coupled to control electronics to prevent or terminate further refrigerant recovery when the container is full. The scale comprises a platform pivotally mounted by a hinge pin to a wheel cart, which also carries the evaporator/condenser unit, compressor, control electronics, and associated valves and hoses.

U.S. Pat. No. 4,805,416, also assigned to the assignee hereof, discloses systems for recovering, purifying and recharging refrigerant in which, during a purification cycle, refrigerant is circulated from a refrigerant storage container in a closed path through a circulation valve and a filter for removing water and other contaminants, and then returned to the container. U.S. Pat. No. 4,939,905, also assigned to the assignee hereof, discloses a refrigerant handling system that includes a multiple-section condenser, and means responsive to refrigerant temperature and pressure at the outlet of the evaporator for automatically and selectively controlling flow of refrigerant from the compressor outlet to the individual condenser sections. This construction permits use of the disclosed system in connection with differing types of refrigerants, such as R12, R22 and R502 without contamination of the refrigerants due to intermixing with refrigerant retained in the condenser.

A problem with refrigerant handling systems of the types discussed above involves clearing system components of refrigerant when it is desired to employ the system with a differing type of refrigerant, or when it is desired to perform routine maintenance or repair on the system components. Components upstream of the compressor inlet can be efficiently cleared by operation of the compressor. However, components downstream of the compressor outlet, such as a condenser or refrigerant filter, retain refrigerant in liquid phase. The multiple-section condenser disclosed in above-noted U.S. Pat. No. 4,939,905 permits operation with differing types of refrigerants. However, it involves the expense of a multiple-sectioned condenser, and is not as readily amenable as desired to retrofit in recovery equipment currently in the field. Furthermore, refrigerant in the condenser sections would be lost to the atmosphere in the event that the condenser is disconnected for repair or other purposes. Likewise, it is important to provide facility for removing refrigerant from a refrigerant filter and associated piping to minimize release of refrigerant to the atmosphere when the filter cartridge must be changed, an operation that must be performed fairly frequently.

OBJECTS AND SUMMARY OF THE INVENTION

It is therefore a general object of the present invention to provide a refrigerant handling system, particularly a refrigerant recovery and/or recycling system, that includes facility for selectively clearing system components of refrigerant without requiring connection of the components to external devices, and with minimum intervention by an operator.

A refrigerant handling system in accordance with the present invention includes a refrigerant pump such as a compressor, and a plurality of refrigerant system components connected in series between a refrigerant source such as a system under service and a refrigerant storage container. To clear a selected system component of refrigerant, such as a refrigerant filter or a refrigerant condenser, a valve is connected between the selected component and the compressor. The valve has multiple ports and valve positions, in one of which refrigerant is fed through the selected component to the storage container in normal operation, and in another of which the selected component is isolated from the storage container and connected to the pump inlet for drawing refrigerant from the component and feeding such refrigerant directly to the container. A check valve cooperates with the multi-port valve to isolate the selected component from the storage container during the clearing mode of operation.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
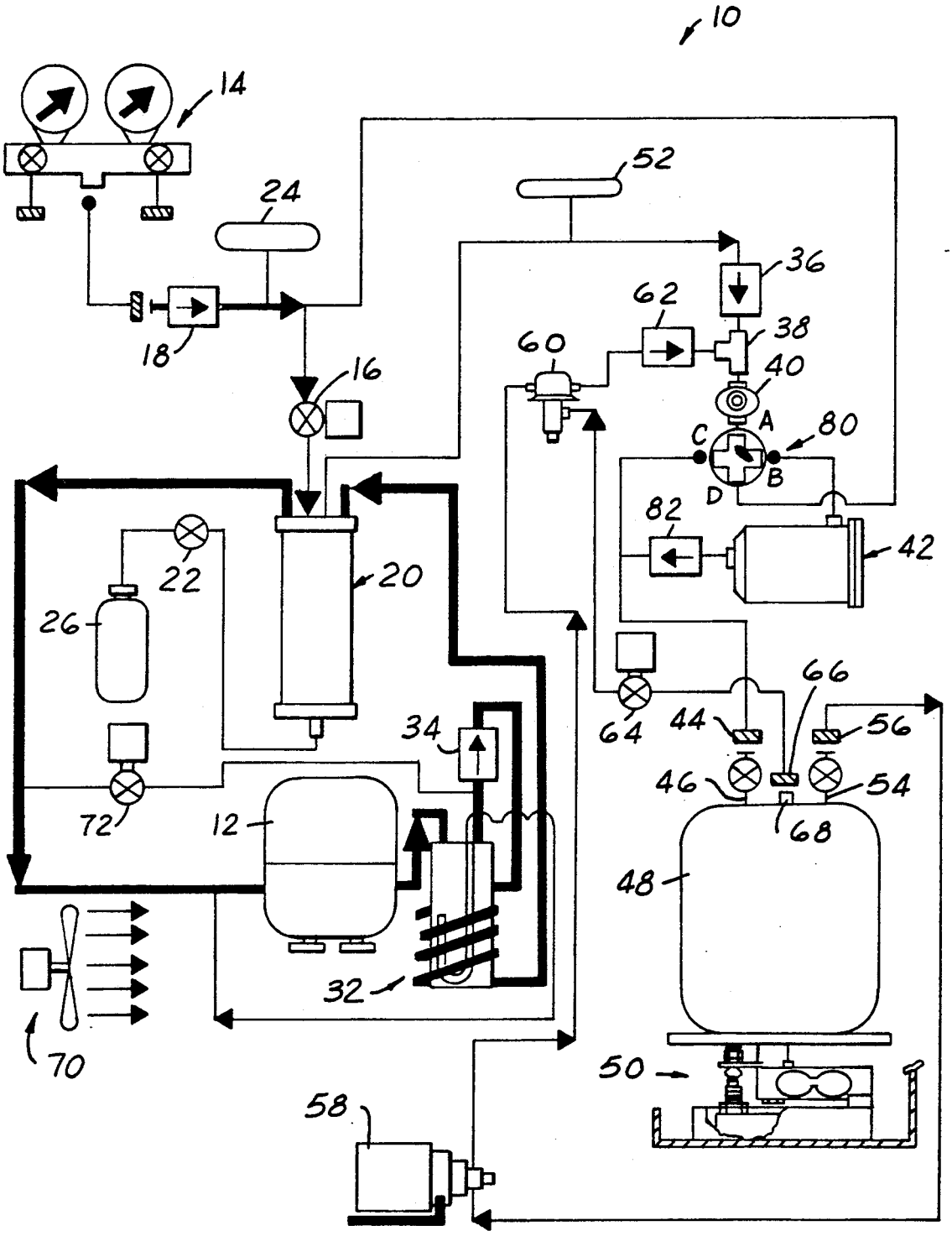
FIG. 1 is a schematic diagram of a refrigerant recovery system in accordance with one presently preferred embodiment of the invention.

FIG. 1 illustrates a refrigerant recovery system 10 that includes a compressor 12 having an inlet that is coupled to an input manifold 14 through a solenoid valve 16, a check valve 18 and the evaporator section of a combined heat-exchange/oil-separation unit 20. A pressure switch 24 is connected between solenoid valve 16 and check valve 18, and is responsive to a predetermined low pressure to the compressor inlet from the refrigeration system under service (connected to manifold 14) to indicate removal or recovery of refrigerant therefrom. The oil drain port of unit 20 is connected by a valve 22 to a catch bottle 26. The outlet of compressor 12 is connected through a compressor oil-separator 32 and a check valve 34 to the inlet of the condenser section of combined unit 20. The outlet of the condenser section of unit 20 is connected through a check valve 36, a T-coupling 38 and a moisture indicator 40 to the inlet of a liquid refrigerant filter 42. Filter 42 is of conventional type, and includes a replaceable filter cartridge for removing water and other contaminants from refrigerant passing therethrough.

The outlet of filter 42 is connected by a quick-disconnect coupling 44 to the vapor port 46 of a liquid refrigerant storage container 48. Container 48 is carried by a scale 50 for indicating weight of refrigerant within the container. A pressure switch 52 is connected between unit 20 and check valve 36 for indicating a high-pressure condition at the outlet side of the condenser section. The liquid port 54 of container 48 is connected through a quick-disconnect coupling 56 to a liquid refrigerant pump 58. The outlet side of pump 58 is connected through a valve 60 and a check valve 62 to T-coupling. 38. Valve 60 is also connected through a solenoid valve 64 and a quick-disconnect coupling 66 to the purge port 68 of container 48. Compressor 12 and oil separator 32 are cooled by a motor-driven fan 70. A solenoid valve 72 is connected between the outlet of oil separator 32 and the inlet of compressor 12 to equalize the pressure across the compressor and facilitate starting of the compressor.

To the extent thus far described, refrigerant handling system 10 is substantially the same as that disclosed in U.S. application Ser. No. 07/556,624 filed Jul. 20, 1990, to which reference is made for more detailed discussion. In general, a refrigeration system from which refrigerant is to be recovered is connected to manifold 14. Solenoid valve 16 and compressor 12 are operated to draw refrigerant from such refrigeration system under service, and to feed refrigerant from the compressor through filter 42 to vapor inlet port 46 of container 48. During a purification mode of operation, which may be run either concurrently with or separately from the recovery mode of operation, pump 58 is operated to draw liquid refrigerant from container port 54, and to feed such refrigerant through filter 42 to vapor port 46. Valve 60 is responsive to temperature of liquid refrigerant flowing therethrough, and to pressure at purge port 68 in the head space of container 48, for purging air from within the container.

In accordance with the present invention, a four-way valve 80 is connected between moisture meter 40 and the inlet of filter 42, and a check valve 82 is connected between the filter outlet and quick-disconnect coupling 44. Valve 80 has four valve ports A, B, C, D (FIGS. 1 and 2A–3B). Port A provides the supply input to the valve through connection to moisture meter 40. Port B is connected to the inlet of filter 42, and port C is connected to quick-disconnect coupling 44 in parallel with check valve 82. Port D is connected to the compressor inlet through the junction of check valve 18 and solenoid valve 16.

Figure 2A:
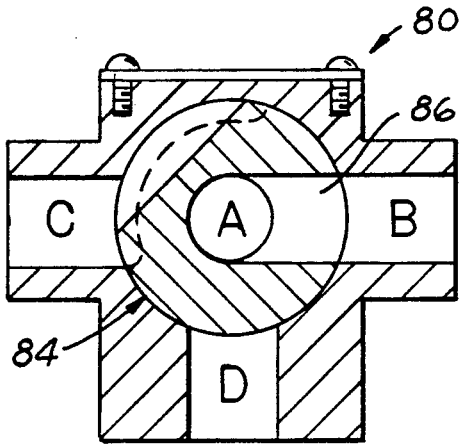
FIGS. 2A and 2B are diagrammatic and schematic views respectively of the four-way valve illustrated in FIG. 1 in a normal mode of operation.
Figure 2B:
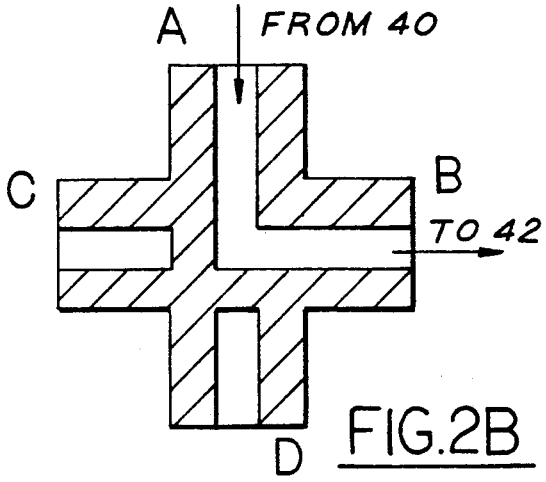
Figure 3A:
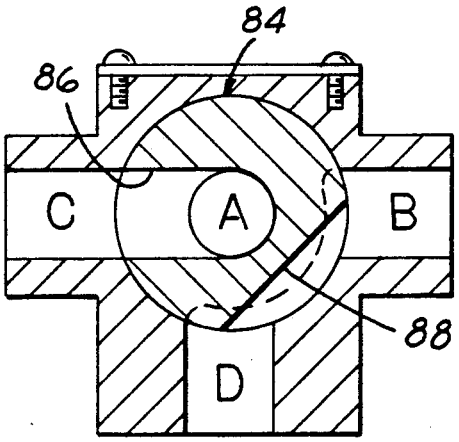
FIGS. 3A and 3B are diagrammatic and schematic illustrations of the four-way valve in a mode of operation for clearing refrigerant from the refrigerant filter in FIG. 1.
Figure 3B:
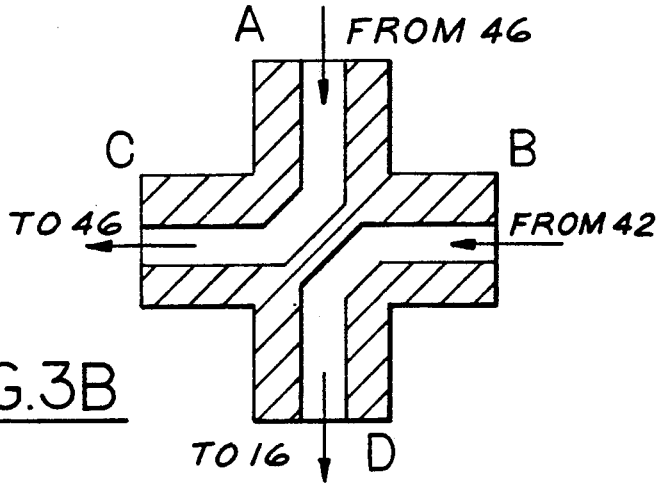

Valve 80 includes a valve element 84 (FIGS. 2A and 3A) coupled to a handle for manually positioning valve element 84 between a first position illustrated in FIGS. 2A and 2B, and a second position illustrated in FIGS. 3A and 3B. In the position of FIGS. 2A and 2B, port A is connected to port B by a right-angle passage 86 that extends through valve element 84. In this position, refrigerant is free to flow from moisture indicator 40 (FIG. 1) to the inlet of filter 42. Ports C and D are isolated from each other by the valve element. When valve element 84 is moved to the position illustrated in FIGS. 3A and 3B, passage 86 interconnects ports A and C, so that moisture indicator 40 is connected directly to quick-disconnect coupling 44 (FIG. 1). At the same time, valve ports B and D are connected to each other by a passage 88 that extends tangentially through the valve element. In this position, the valve connects the inlet of filter 42 through ports B and D to the inlet side of compressor 12 through solenoid valve 16 and the evaporator section of unit 20. Thus, in the position of valve 80 illustrated in FIGS. 3A and 3B, refrigerant is drawn by compressor 12 from filter 42 through valves port B and D, and is fed by the compressor through valve ports A and C to storage container 48. Filter 42 may thus be cleared of refrigerant prior to replacement of the filter cartridge contained therewithin. After the filter cartridge has been replaced, valve 80 is returned to the normal position illustrated in FIGS. 2A and 2B.

Figure 4:
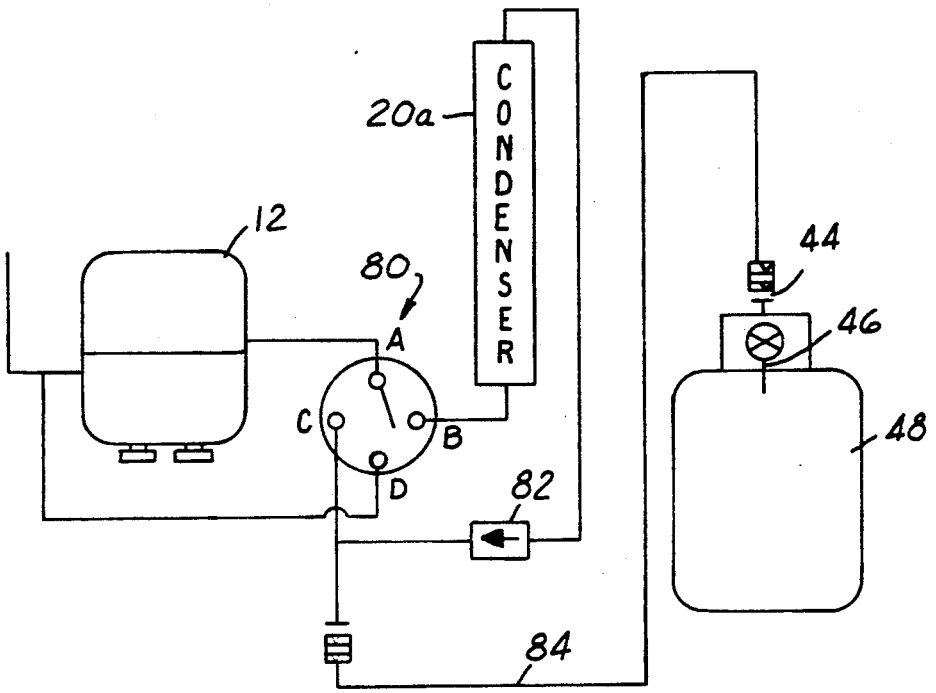
FIGS. 4 and 5 are fragmentary schematic diagrams of alternative embodiments of the invention.

FIG. 4 illustrates a modified embodiment of the invention for selectively clearing liquid refrigerant from condenser **20*a* preparatory to maintenance or repair on the condenser, or preparatory to operation of the system in connection with a differing type of refrigerant. In the embodiment of FIG. 4, supply port A of valve 80 is connected to the outlet of compressor 20, either directly or through compressor oil separator 32 (FIG. 1). Port B of valve 80 is connected through condenser 20*a* (FIG. 1), and through check valve 82 and a removable hose 84 to vapor port 46 of storage container 48. Port C is likewise connected to hose 84 in parallel with check valve 82, and port D is connected to the inlet side of compressor 12**.

With valve 80 in the normal position (FIGS. 2A and 2B), ports A and B are connected to each other, and ports C and D are isolated. Refrigerant may then flow in the usual manner from compressor 12 through valve 80, condenser **20*a* and check valve 82 to storage container 88. On the other hand, to clear condenser 20*a* of refrigerant, valve 80 is moved to the position illustrated in FIG. 3A, in which the condenser inlet is connected through ports B and D to the inlet side of compressor 12, and valve ports A and C provide direct connection of the compressor outlet to storage container 48. As with the embodiment of FIG. 1, check valve 82** prevents flow of refrigerant from the compressor outlet through the condenser during the condenser-clearing operation.

Figure 5:
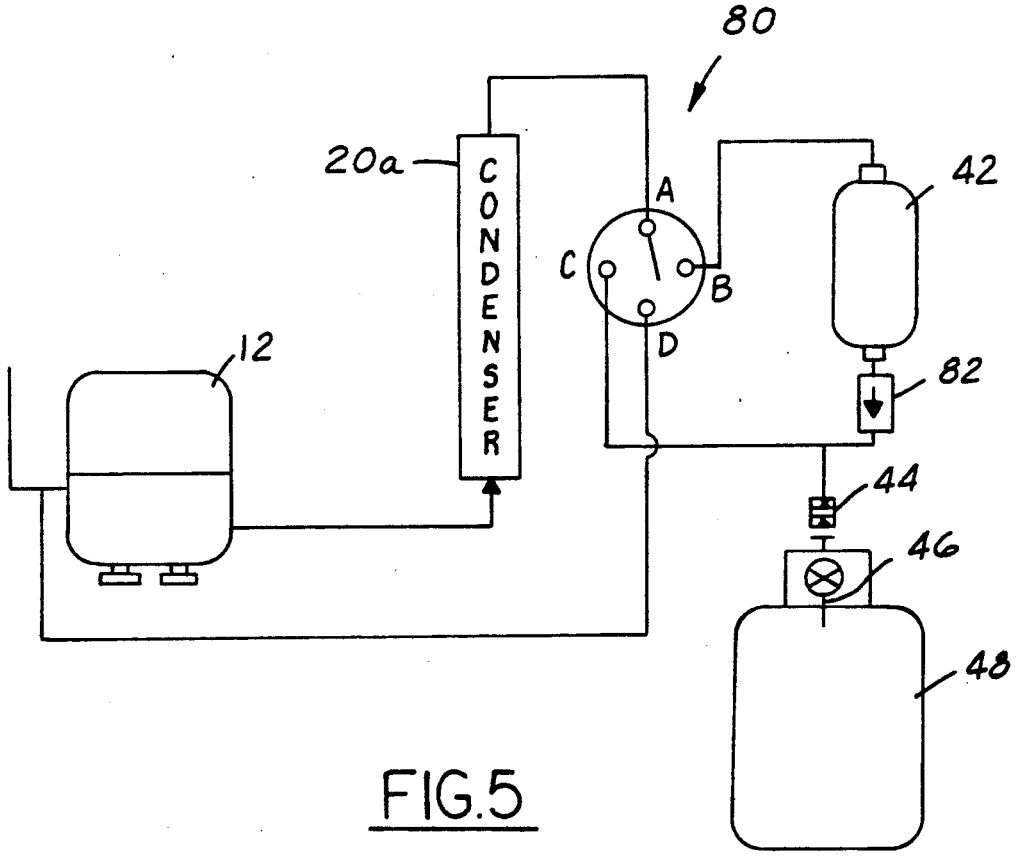

FIG. 5 is a schematic diagram of apparatus similar to that illustrated in FIG. 1, and illustrates that many components of the apparatus of FIG. 1 are not in any way essential to implementation of the invention in its broadest aspects.

Figure 6A:
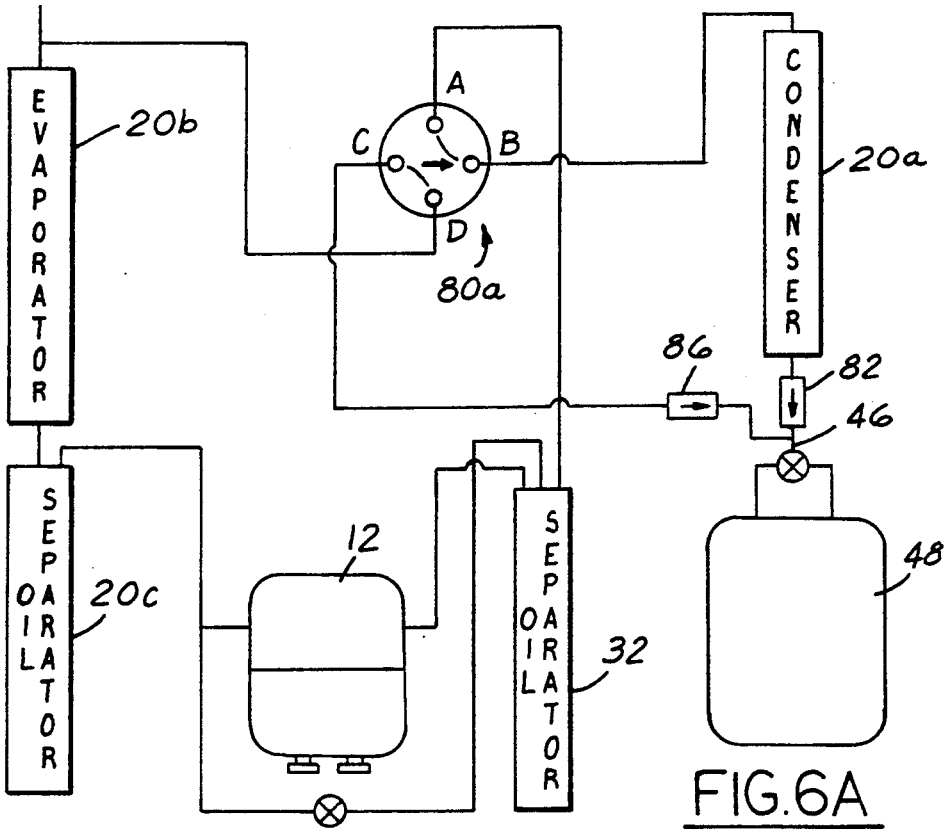
FIGS. 6A and 6B are schematic diagrams of a further modified embodiment of the invention in normal and clearing modes of operation respectively.
Figure 6B:
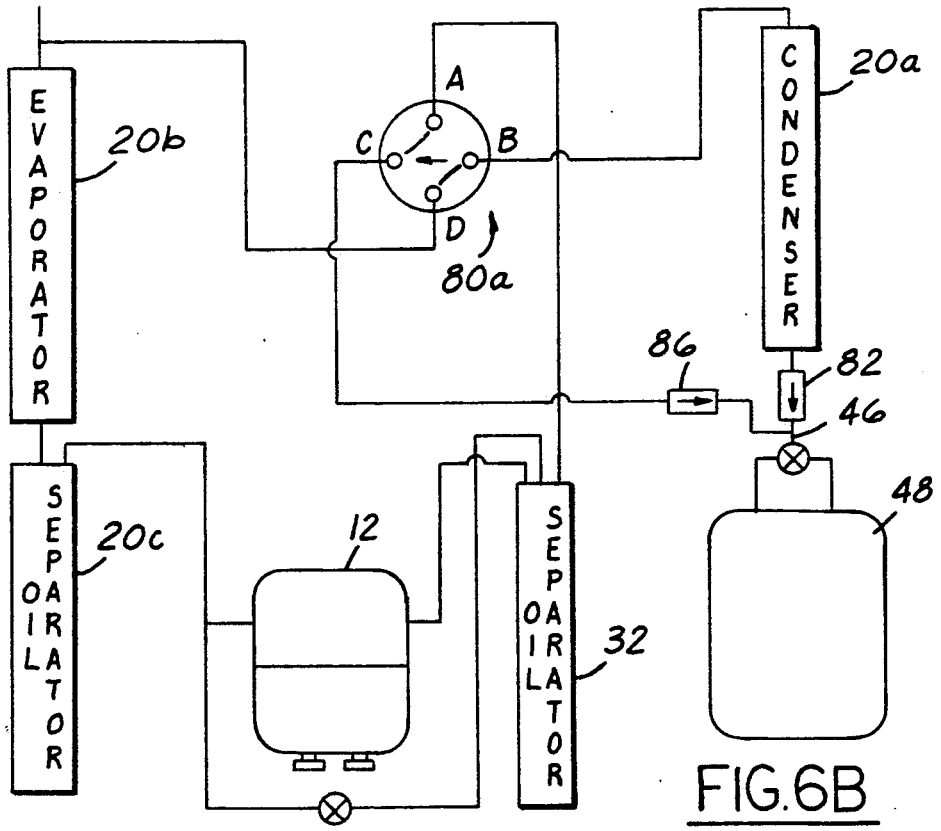

FIGS. 6A and 6B illustrate a further embodiment of the invention. Four-way valve **80*a* has port A connected to the discharge of compressor 12 through oil separator 32, and port B is connected to the inlet of condenser 20*a*. Port C of valve 80*a* is connected through a check valve 86 to vapor port 46 of container 48. Valve port D is connected to the inlet side of evaporator 20*b*, which in turn is connected through oil separator 20*c* to the inlet or suction side of compressor 12. In the normal position of valve 80*a* illustrated in FIG. 6A, refrigerant from the discharge side of compressor 12 flows through valve ports A and B to condenser 20*a*, and thence through check valve 82 to vapor port 46 of container 48. Ports C and D of valve 80***a* are again isolated from system operation, but this time by means of check valve 86 that prevents reverse flow of refrigerant from container port 46 to evaporator 20*b*. When it is desired to clear condenser 20*a*, valve 80*a* is moved to the position illustrated schematically in FIG. 6B in which valve ports A and C are interconnected and valve ports B and D are interconnected. In this valve position, the inlet of condenser 20*a* is connected through valve ports B and D to the inlet side of evaporator 20*b*, and thence to the suction side of compressor 12. The compressor outlet or discharge side is connected through valve ports A and C, and check valve 86 directly to vapor port 46 of container 48. Thus, addition of check valve 86 to the embodiment of FIG. 4 allows use of a standard four-way valve 80*a* in place of the valve 80 (FIGS. 2A-3B) in which the passage 88 must be specially manufactured.

It will be recognized that, although the invention enjoys particular utility in a refrigerant recovery system, the invention is in no way limited thereto in its broadest aspects. Indeed, the invention may be employed in any refrigerant handling system in which clearing of one or more components of refrigerant, particularly on the outlet side of the refrigerant pump, is desirable for any reason.

We claim:

1. In a refrigerant handling system that includes refrigerant pump means and a plurality of refrigerant system components each having an inlet and an outlet, and means for connecting said components in series through said refrigerant pump means to a refrigerant storage container to feed refrigerant to the container, means for selectively clearing at least one of said components of refrigerant comprising:

a valve having first, second, third and fourth ports, valve means having a first position connecting said first port to said second port, and a second position connecting said first port to said third port and said second port to said fourth port, and means for selectively positioning said valve means in said first and second positions, means connecting said first port upstream of said component and means connecting said second port to said component inlet such that said first and second ports in said valve means are part of said series connection in said first position of said valve means, means for connecting said third port to the storage container, means connecting said fourth port to said pump inlet, means including a check valve for connecting said outlet of said component to the refrigerant storage container for permitting flow of refrigerant from said component outlet to the storage container but preventing flow of refrigerant into said component outlet, and means blocking refrigerant flow from said third port to said fourth port in said first position of said valve means.

2. The system set forth in claim 1 wherein said flow-blocking means comprises said valve means.

3. The system set forth in claim 1 wherein said flow-blocking means comprises a second refrigerant check valve.

4. The system set forth in claim 1 wherein said component comprises filter means for removing contaminants from refrigerant passing therethrough.

5. The system set forth in claim 1 wherein said component comprises a condenser for at least partially condensing refrigerant passing therethrough.

* * * * *